US012287169B2

(12) United States Patent
D'Eusebio et al.

(10) Patent No.: US 12,287,169 B2
(45) Date of Patent: Apr. 29, 2025

(54) INSTALLATION PROVIDED WITH LINKLESS AMMUNITION LOADING SYSTEM

(71) Applicant: LEONARDO S.P.A., Rome (IT)

(72) Inventors: Manuel D'Eusebio, La Spezia (IT); Claudio Nardi, La Spezia (IT); Luca Mineo, La Spezia (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 18/566,040

(22) PCT Filed: Jun. 7, 2022

(86) PCT No.: PCT/IB2022/055273
§ 371 (c)(1),
(2) Date: Nov. 30, 2023

(87) PCT Pub. No.: WO2022/259131
PCT Pub. Date: Dec. 15, 2022

(65) Prior Publication Data

US 2024/0280338 A1 Aug. 22, 2024

(30) Foreign Application Priority Data

Jun. 8, 2021 (IT) ..... 102021000014819

(51) Int. Cl.
*F41A 9/02* (2006.01)
*F41A 9/04* (2006.01)
*F41A 27/00* (2006.01)

(52) U.S. Cl.
CPC ..... *F41A 9/02* (2013.01); *F41A 9/04* (2013.01); *F41A 27/00* (2013.01)

(58) Field of Classification Search
CPC ..... F41A 9/02; F41A 9/04; F41A 9/05; F41A 27/00; F41A 27/06; F41A 27/22; F41A 27/24
See application file for complete search history.

(56) References Cited

U.S. PATENT DOCUMENTS 1,332,060 A 2/1920 Pacilli
2,971,438 A * 2/1961 Fox ..... F41A 9/26 198/478.1

(Continued)

OTHER PUBLICATIONS

International Search Report and Written Opinion for PCT/IB2022/055273 (Aug. 23, 2022).

(Continued)

*Primary Examiner* — Bret Hayes
(74) *Attorney, Agent, or Firm* — Merchant & Gould P.C.

(57) ABSTRACT

The installation includes a traversing portion configured to be rotatably mounted and supported on a stationary support structure, to rotate about a traversing axis. An elevating portion is rotatably supported by the traversing portion about an elevating axis perpendicular to the traversing axis. A firearm assembly supported by the elevating portion has a barrel configured to fire linkless ammunitions through firearm assembly. A magazine is configured to contain a plurality of linkless ammunitions to be fed to the barrel. A feeding assembly is configured to transfer the linkless ammunitions from the magazine to the barrel. The magazine is carried by the traversing portion and is operatively integral therewith. The feeding assembly is carried by the elevating portion and is operatively integral therewith. A transfer device mounted on the traversing portion is configured to transfer the linkless ammunitions (A) from the magazine to the feeding assembly.

7 Claims, 9 Drawing Sheets

(56) References Cited

U.S. PATENT DOCUMENTS

| | | | | | |
|---|---|---|---|---|---|
| 3,045,553 | A | | 7/1962 | Mösle | |
| 4,244,271 | A | * | 1/1981 | Gaboriault | F41A 9/02 89/33.14 |
| 4,440,061 | A | * | 4/1984 | Magnuson | F41A 27/08 89/37.07 |
| 4,492,144 | A | | 1/1985 | Dix | |
| 4,674,392 | A | * | 6/1987 | Beckmann | F41A 9/37 198/367 |
| 4,840,108 | A | | 6/1989 | Hürlemann et al. | |
| 5,076,138 | A | * | 12/1991 | Mannhart | F41A 9/04 89/34 |
| 6,591,733 | B1 | * | 7/2003 | Engstrom | F41A 9/16 89/46 |
| 8,215,225 | B1 | * | 7/2012 | Zangrando | F41A 9/45 89/46 |
| 2002/0144590 | A1 | * | 10/2002 | Grange | F41A 9/04 89/46 |

OTHER PUBLICATIONS

International Preliminary Report on Patentability for PCT/IB2022/05527 (Sep. 15, 2023).

* cited by examiner

INSTALLATION PROVIDED WITH LINKLESS AMMUNITION LOADING SYSTEM

This application is a National Stage Application of PCT/IB2022/055273, filed Jun. 7, 2022, which claims benefit of priority to Italian Patent Application No. 102021000014819, filed Jun. 8, 2021, and which applications are incorporated herein by reference. To the extent appropriate, a claim of priority is made to each of the above disclosed applications.

TECHNICAL FIELD

The present invention relates to an installation provided with a linkless ammunition loading system, in particular for artillery installations.

TECHNICAL BACKGROUND

Installations are known in the industry which are provided with linkless ammunition loading systems; in this respect, it would be desirable to make available further installations including loading systems differing from those currently known in the art.

U.S. Pat. No. 1,332,060 A describes an installation comprising a traversing portion configured to be rotatably mounted and supported on a stationary support structure, so as to rotate about a traversing axis. An elevating portion is rotatably supported by the traversing portion about an elevating axis substantially perpendicular to the traversing axis. A firearm assembly is supported by the elevating portion and comprises a barrel configured to fire ammunitions through itself. A magazine is carried by the traversing portion and is configured to contain a plurality of linkless ammunitions to be fed to the barrel. A feeding assembly is configured to transfer the linkless ammunitions from the magazine to the barrel for firing the linkless ammunitions. The feeding assembly is carried by the elevating portion. A transfer device is configured to transfer the linkless ammunitions from the magazine to the feeding assembly.

U.S. Pat. No. 4,492,144 A discloses a slip ring for the transport of linkless ammunition and fired cases between a supply means which is stationary with respect to a support and a gun which is journaled for rotation about an axis with respect to said support, comprising: a first transport means which is stationary with respect to said support and is adapted to be driven by the gun; a second transport means which is journaled for rotation about said axis with said support, and a differential means disposed between said first and second transport means and journaled for rotation about said axis with respect to said first and second transport means, said differential means including a plurality of compartments, each for receiving a respective round or case, said first and second transport means each respectively inserting into, or extracting rounds or cases from, said compartments, said first transport means directly coupled to and driving said differential means which is directly coupled to and drives said second transport means.

U.S. Pat. No. 4,840,108 A discloses an ammunition infeed apparatus for an automatic firing weapon. This ammunition infeed apparatus comprises an ammunition container filled with a plurality of ammunition loading or cartridge clips. The ammunition container rotates with the firing weapon about the azimuth axis. There is also provided a device for the ejection of the full ammunition loading clips from the ammunition container, a device for the extraction or stripping of the cartridges or ammunition from the ammunition loading clips. This extraction or stripping device comprises an endless conveyor band. Also provided is a flexible endless chain for the transport of the ammunition or cartridges stripped from the ammunition loading clips to the firing weapon.

SUMMARY OF THE INVENTION

It is one object of the present invention to realize an installation provided with an improved loading system capable of overcoming the drawbacks of the techniques currently available on the market.

According to the present invention, this and other objects are achieved through an installation provided with a loading system.

It is understood that the appended claims are an integral part of the technical teachings provided in the following detailed description of the present invention.

In particular, the installation provided with the loading system offers the following advantages, which are in particular due to some preferred, though not essential, aspects of the present invention:

- loading of linkless ammunitions;
- heightwise and widthwise compact automatic loading, resulting in reduced turret volumes;
- smaller front area to be protected because, due to the fact that ammunition storage is moved to the traversing mass, the turret geometry is reduced and the inertia variation caused by the movements of the ammunitions in the elevating mass is cancelled;
- since there are no links connecting the ammunitions, the typical ballistic window for discharging such links is eliminated;
- possibility of loading the firearm with different ammunition types per feeding branch;
- possibility of replenishment of two separate magazines in the traversing mass directly from the crew space, which is situated within the hull under the turret base plane and is therefore separated from the rest of the vehicle by a ballistic protection; this facilitates the replenishment operation, while at the same time improving crew safety, since it is not necessary to climb up into the turret space.

Further features and advantages of the present invention will become apparent in light of the following detailed description, provided herein merely as a non-limiting example and referring, in particular, to the annexed drawings as summarized below.

Figure 1:
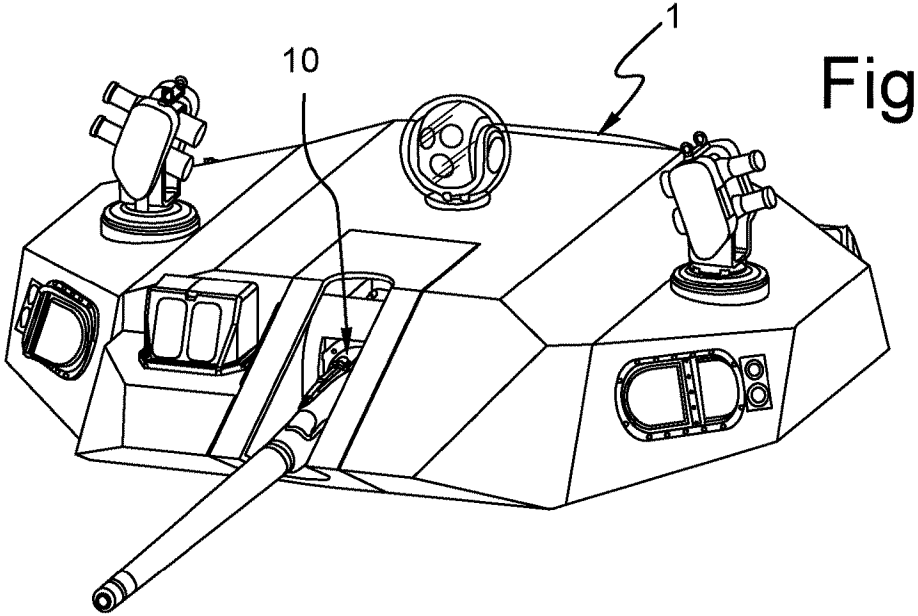
FIGS. 1 and 1*a* show, respectively, a perspective front top view and a partially transparent perspective rear top view, both of which concern a turret whereon an installation comprising a loading system according to the present invention has been mounted.

For completeness' sake, the following is a list of alphanumerical references and names used herein to identify parts, elements and components illustrated in the above-summarized drawings.

Z. Traversing axis
Y. Elevating axis
x1. Mounting axis
x2. Thrust axis
W. Star element rotation axis
P0. Magazine path
P1. Conveying path
P2. Loading path
A. Ammunitions
1. Turret
10. Artillery installation
12. Traversing mass
14. Elevating mass
16. Firearm assembly
18. Barrel
20. Magazine
22. Feeding assembly
24. Transfer device
25. Inlet of the feeding assembly and conveying guide
26. Conveying guide
27. Star element
28. Conveying mechanism
29. Crank
30. Sliding structure
30*a*. Lateral rail portion
30*b*. Central rail portion
32. Conveying chain
34. Pushing members
35. Lever
36. Chain links
36*a*. Horizontal chain links
36*b*. Vertical chain links
37. Thrust spring
38. Sliding pins
38*a*. Lateral sliding pins
38*b*. Central sliding pins
39. C-shaped bodies
39*a*. Horizontal C-shaped bodies
39*b*. Vertical C-shaped bodies
40. Rollers
41. Through bores
41*a*. (First) through bores
41*b*. (Second) through bores
42. Gear wheels
46. Loading guide
48. Loading mechanism
50. Loading star elements

DETAILED DESCRIPTION OF THE INVENTION

Figure 1A:
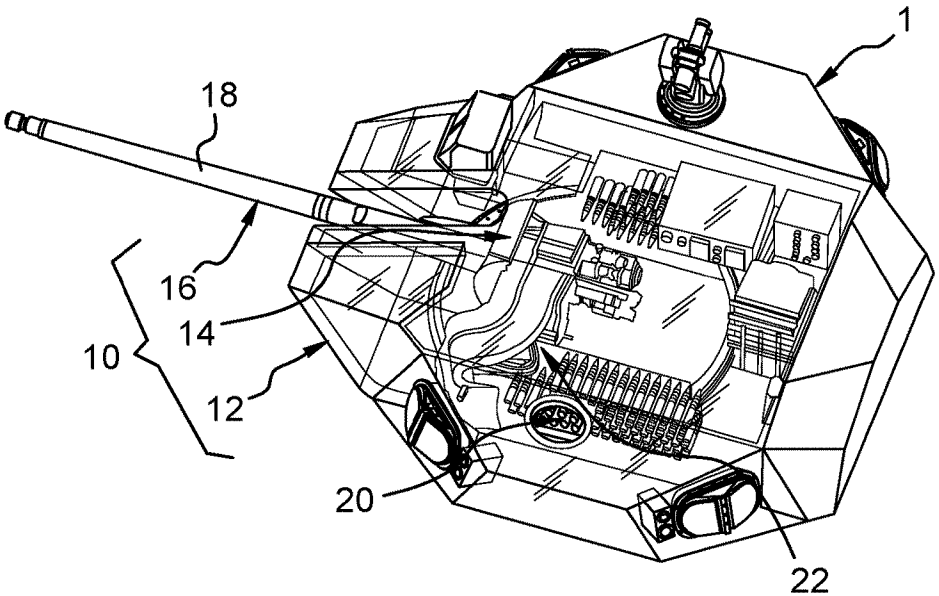

With reference to FIGS. 1 and 1*a*, numeral 1 designates as a whole a turret equipped with an artillery installation 10.

Installation 10 is particularly suitable for installation on terrestrial vehicles, e.g. armoured vehicles such as tanks. Nevertheless, it may be used for other applications as well, e.g. aircraft, ships or fixed installations.

Figure 2:
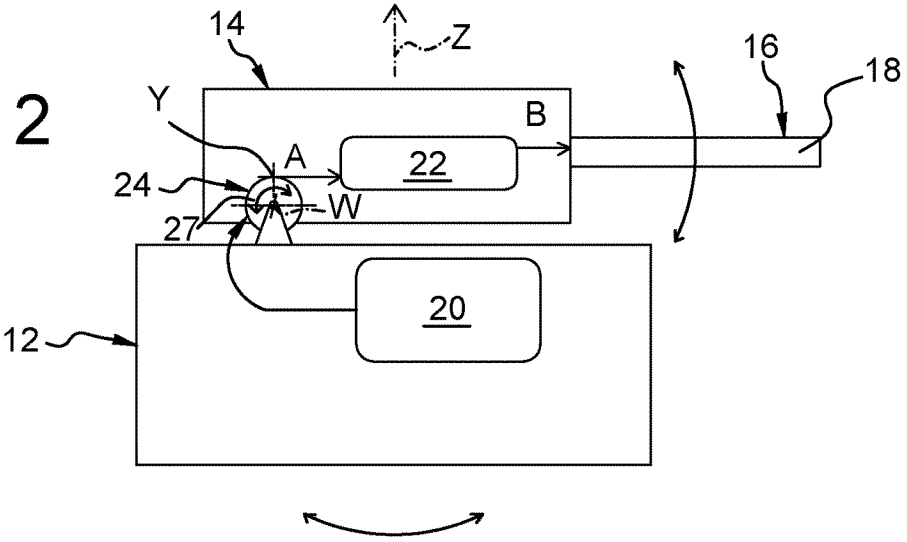
FIG. 2 shows a block diagram of an installation comprising a loading system obtained in accordance with an exemplary embodiment of the present invention.
Figure 3:
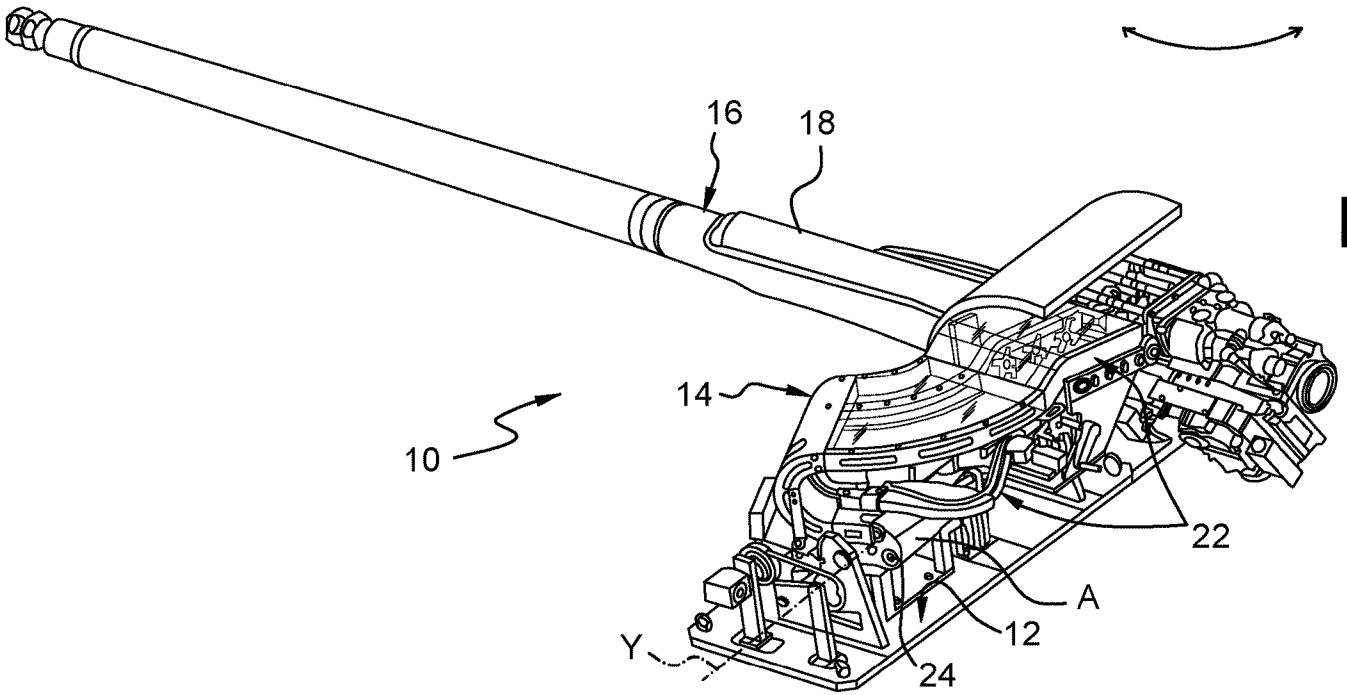
FIG. 3 shows a partial perspective rear top view of the installation comprising the loading system shown in the preceding figures.

With reference to FIG. 2, installation 10 is represented by means of a block diagram, whereas in FIG. 3 the construction details of such installation 10 are shown in a perspective rear view. In a per se known manner, artillery installation 10 comprises a traversing portion or mass 12, an elevating portion or mass 14, and a firearm assembly 16.

Traversing mass 12 is configured to be rotatably mounted and supported on a stationary support structure (not numbered), so as to rotate about a substantially vertical traversing (or azimuthal) axis Z.

Elevating mass 14 is rotatably supported by traversing mass 12 about an elevating axis Y, which is substantially horizontal and perpendicular to vertical axis Z. In particular, when viewing FIG. 2, elevating axis Y substantially corresponds to an axis entering perpendicularly through the sheet plane. In a per se known manner, typically traversing mass 12 and elevating mass 14 are mutually assembled by means of a pair of cheeks (details not shown) fixed to traversing mass 12, whereon elevation bearings are mounted, particularly at elevating axis Y).

A firearm assembly 16 is in turn supported by elevating mass 14. Moreover, firearm assembly 16 comprises a barrel 18 configured to fire ammunitions A. In the embodiment illustrated herein, barrel 18 is a cannon, e.g. having a calibre of 30 mm.

Installation 10 comprises also a magazine 20 configured to contain a plurality of ammunitions A to be fed to barrel 18. In particular, magazine 20 is configured to automatically move the plurality of ammunitions A. Furthermore, ammunitions A contained in the magazine are of the type not mutually connected by links—also referred to as linkless ammunitions.

Magazine 20 is carried by traversing mass 12 and is operatively integral therewith; in particular, as will be further explained hereinafter, magazine 20 is separate and distinct from elevating mass 14.

In the embodiment illustrated herein, magazine 20 has, at its outlet, a star-element conveyor of a per se known type (not numbered), which dispenses ammunitions A out of itself.

Artillery installation 10 further comprises a feeding assembly 22 configured to transfer ammunitions A coming from magazine 20 to barrel 18, for such ammunitions A to be fired through the latter.

In the embodiment illustrated herein, feeding assembly 22 is carried by elevating mass 14 and is operatively integral therewith; in particular, unlike magazine 20, feeding assembly 22 is separate and distinct from traversing mass 12.

Furthermore, artillery installation 10 comprises a transfer device (or "exchanger") 24 configured to transfer ammunitions A from magazine 20 to feeding assembly 22.

In particular, transfer device 24 is mounted on traversing mass 12.

The following will describe further technical features of this exemplary embodiment of the present invention.

In the implementation example illustrated herein, transfer device 24 is mounted in proximity to the elevating axis Y.

As will be described in more detail below, also with reference to some preferred and optional technical features of the present invention, due to this arrangement of transfer device 24 the mutual arrangement between transfer device 24, carried by traversing mass 12, and inlet 25 of feeding assembly 22, carried by elevating mass 14, always remains substantially the same for any angle of elevation assumed by elevating mass 14 relative to traversing mass 12 about elevating axis Y; therefore, ammunitions A can be conveyed from magazine 20 to barrel 18 (through feeding assembly 22) in any mutual operating condition of traversing mass 12 and elevating mass 14 of artillery installation 10.

Figure 4:
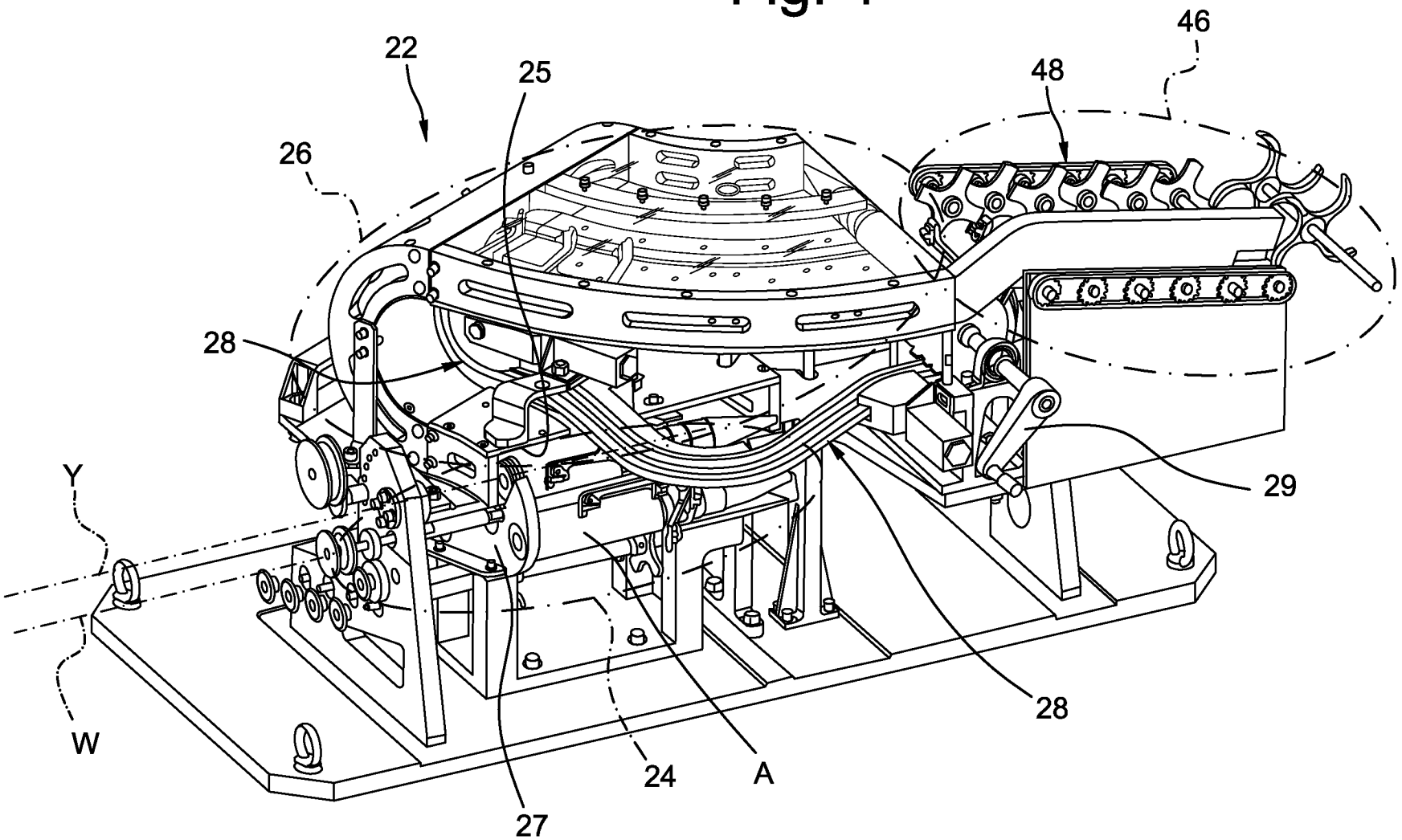
FIG. 4 shows a partially transparent perspective view, magnified compared with FIG. 3, of an ammunition feeding assembly for the installation shown in the preceding figures.

With particular reference to FIG. 4, there is shown a magnified view of feeding assembly 22 visible in the preceding figures.

Feeding assembly 22 comprises a conveying guide 26 mounted on elevating mass 14 and defining a path for transporting ammunitions A from transfer device 24 towards barrel 18. In the illustrated embodiment, the inlet of feeding assembly 22 substantially coincides with the inlet of conveying guide 26, and both are designated by the same reference numeral 25.

In particular, inlet 25 of conveying guide 26, whereat ammunitions A coming from magazine 20 are made to arrive via a star element, e.g. a three-lobed one (not numbered in FIG. 4), is situated in the vicinity of e elevating axis Y. Ammunitions A are intended to enter—and subsequently slide—therein with their side facing conveying duct 26. As will be further described below, conveying guide 26 is advantageously provided as a rigid conduit.

Figure 6:
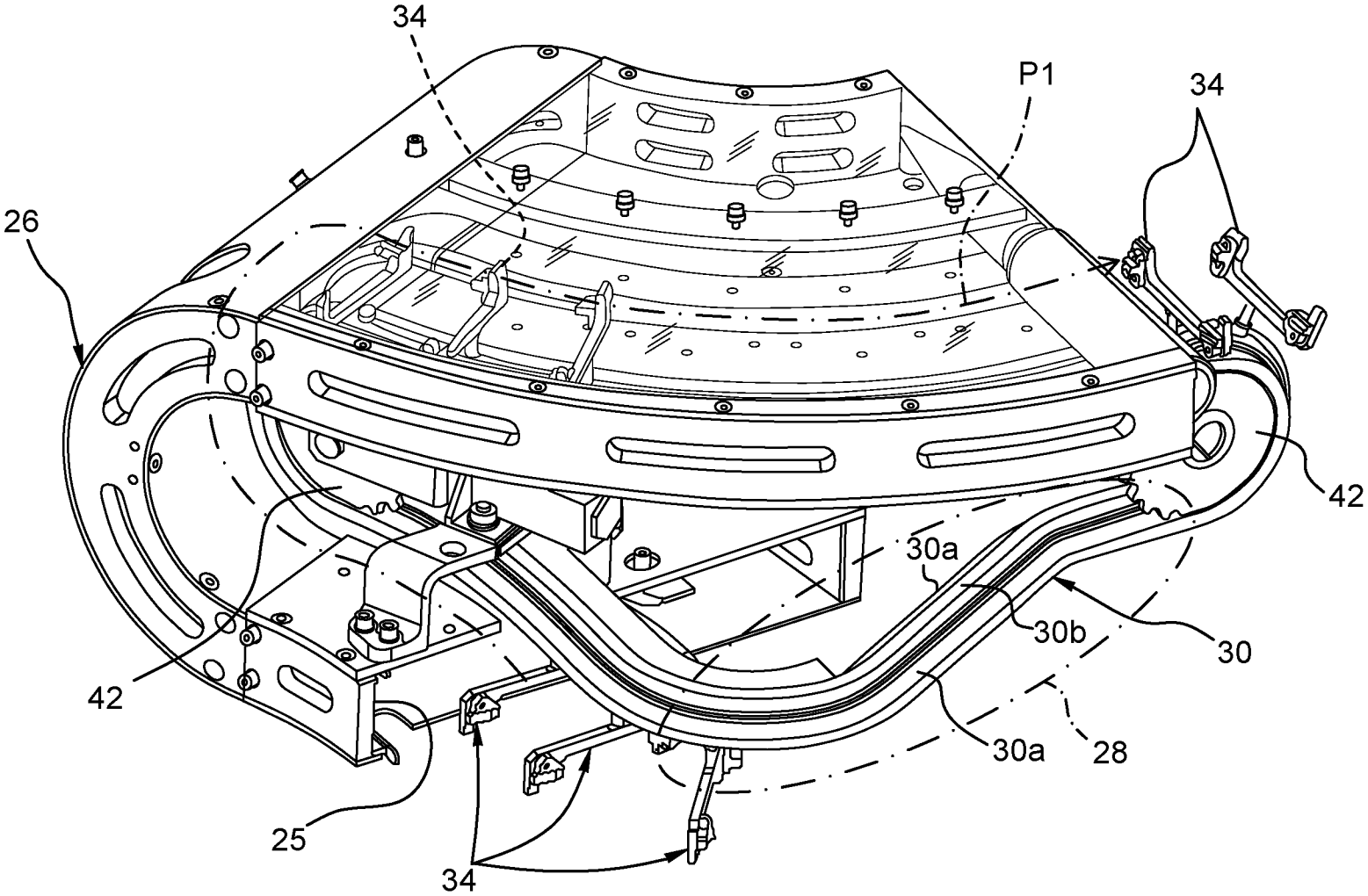
FIG. 6 shows a partially transparent perspective view, further magnified compared with FIG. 3, concerning an ammunition conveying guide of the feeding assembly shown in FIG. 4.

With particular reference to FIGS. 4 and 6, conveying guide 26 defines an open path, in particular a path shaped as a whole as a horizontally turned J. Moreover, the path defined by conveying guide 26 extends in three dimensions in space and, being compact, makes it possible to reduce the total transversal and lateral dimensions of feeding assembly 22.

The rigid conduit formed by conveying guide 26 is, for example, implemented as an open channel in which ammunitions A can slide. In particular, such rigid conduit has a substantially rectangular cross-section, suitable for receiving ammunitions A with their side facing forwards and for directing them towards barrel 18. Furthermore, said conveying conduit or channel is rigid.

Transfer device 24 is configured to pick up ammunitions A as they exit magazine 20 and supply them to inlet 25 of conveying guide 26.

Figure 5:
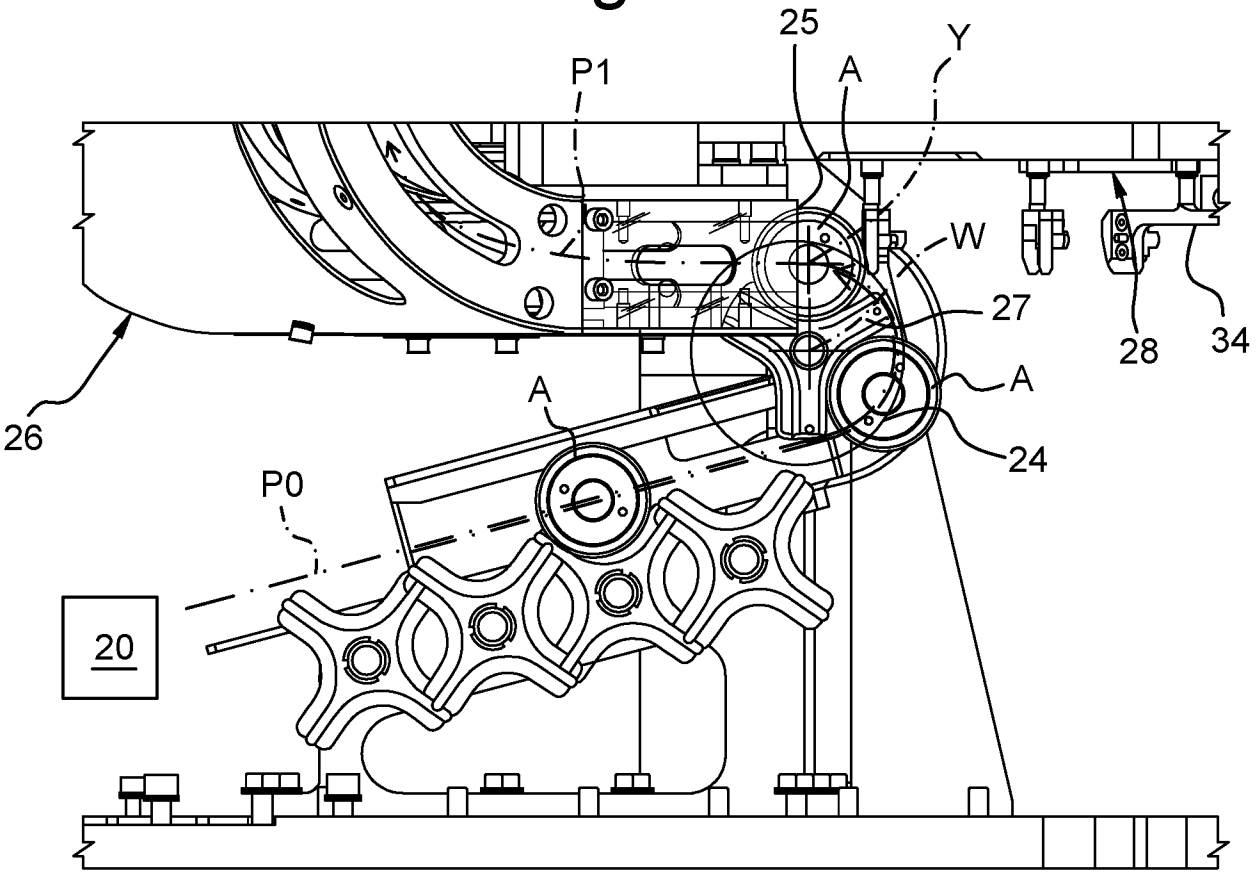
FIG. 5 shows a perspective view, further magnified compared with FIG. 3, concerning an ammunition transfer device for the feeding assembly shown in FIG. 4.

In FIGS. 5 and 6, for completeness' sake, arrows schematically indicate the path followed by ammunitions A between magazine 20 and conveying guide 26. In particular, the arrow designated as P0 indicates the magazine path initially followed by ammunitions A exiting magazine 20, which are then picked up by transfer device 24. The arrow designated as P1 indicates the conveyance path followed by ammunitions A going through conveying guide 26. As shown more clearly in FIG. 6, conveyance path P1 is substantially curvilinear and bends upwards, rotating by about 180°, thus "overturning" the ammunitions from their previous orientation at inlet 25 of conveying guide 26.

Transfer device 24 additionally comprises star element 27, in particular a three-lobed one, rotatably supported about a rotation axis W situated in proximity to the elevating axis Y. In the implementation example illustrated herein, star element 27 is aligned with feeding assembly 22.

Multi-lobed star element 27 is configured to rotate and pick up ammunitions A exiting magazine 20 and supply them to inlet 25 of feeding assembly 22, and in particular to the conduit formed by conveying guide 26, for moving them towards barrel 18. As can be seen, ammunitions A are picked up laterally by star element 27 from the outlet of magazine 20, and are then delivered to inlet 25 of conveying guide 26 (in particular, to the inlet of the rigid conduit defined by the latter).

Inlet 25 of conveying guide 26 (e.g. the inlet of the rigid conduit defined by the latter) is located at the elevating axis Y, being in particular crossed transversally by the latter.

Preferably, rotation axis W is substantially parallel to elevating axis Y; in the embodiment illustrated herein, the distance between rotation axis W and elevating axis Y is such that, in at least a part of the rotation path of star element 27, the centre of ammunition A to be picked up by star element 27 lies substantially on elevating axis Y.

In particular, the rotation axis W is spaced apart vertically (i.e. along the direction of the traversing axis Z) from elevating axis Y.

According to a further embodiment, transfer device 24 may advantageously be driven by a motor, e.g. via a gear transmission that controls the rotation of star element 27 about rotation axis W.

Feeding assembly 22 further comprises a conveying mechanism 28 configured to push ammunitions A along conveying guide 26. In particular, conveying mechanism 28 may be driven by means of a motor (not shown) and/or manually, e.g. by means of a crank 29.

According to one possible embodiment of the present invention, the transmission of the motion from conveying mechanism 28 in elevating mass 14 to transfer device 24 in traversing mass 12 may occur through a mechanical connection consisting of a differential gear (not shown in the drawing) that ensures synchronized motion.

Conveying mechanism 28 comprises a hollow sliding structure 30 and a conveying chain 32 sliding in the cavity defined by sliding structure 30. Some exemplary technical features of conveying chain 32 are visible in more detail in FIGS. 7, 8 and 8*a*.

Conveying mechanism 28 comprises also a plurality of pushing members 34 sliding in conveying guide 26 and carried by conveying chain 32. Each one of pushing members 34 is configured for pushing a respective ammunition A adjacent thereto, which is guided by conveying guide 26.

Sliding structure 30 extends substantially parallel to conveying guide 26. In particular, sliding structure 30 is fixed to conveying guide 26, e.g. being surrounded along at least a part of its extension by conveying guide 26.

Furthermore, as will be described more in detail hereinafter, preferably sliding structure 30 is essentially a rail in which conveying chain 32 slides and from/by which pushing members 34 are suspended and/or supported, which then extend and slide in uconveying guide 26. In particular, the rail comprises a plurality of rail portions 30*a*, 30*b*, extending parallel to and facing each other.

Conveying chain 32 forms a closed loop and is configured to transmit a forward motion to pushing members 34 mounted thereon. Also, conveying chain 32 comprises a plurality of chain links 36 mutually connected in an articulated manner. More in detail, chain links 36 can move, in particular by rotating in different planes, in order to follow the path delimited by conveying guide 26.

In the embodiment illustrated herein, each one of pushing members 34 is shaped substantially as a widened fork, the neck of which—which protrudes and is supported by respective chain link 36—branches off laterally into two arms.

In the embodiment illustrated herein, each one of chain links 36 substantially defines a closed-loop shape (e.g. wherein the closed loop forms a substantially rectangular or square shape).

Figure 7:
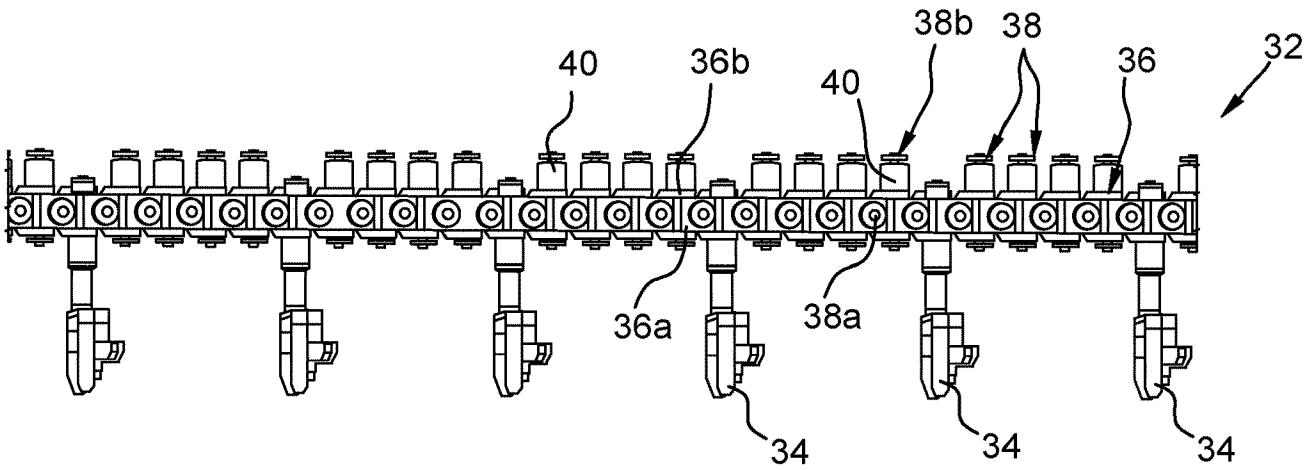
FIGS. 7 and 8 show, respectively, side views and perspective of the feeding mechanism of the feeding assembly shown in the preceding figures, which includes a chain. These figures also show ammunition pushing members.
Figure 8:
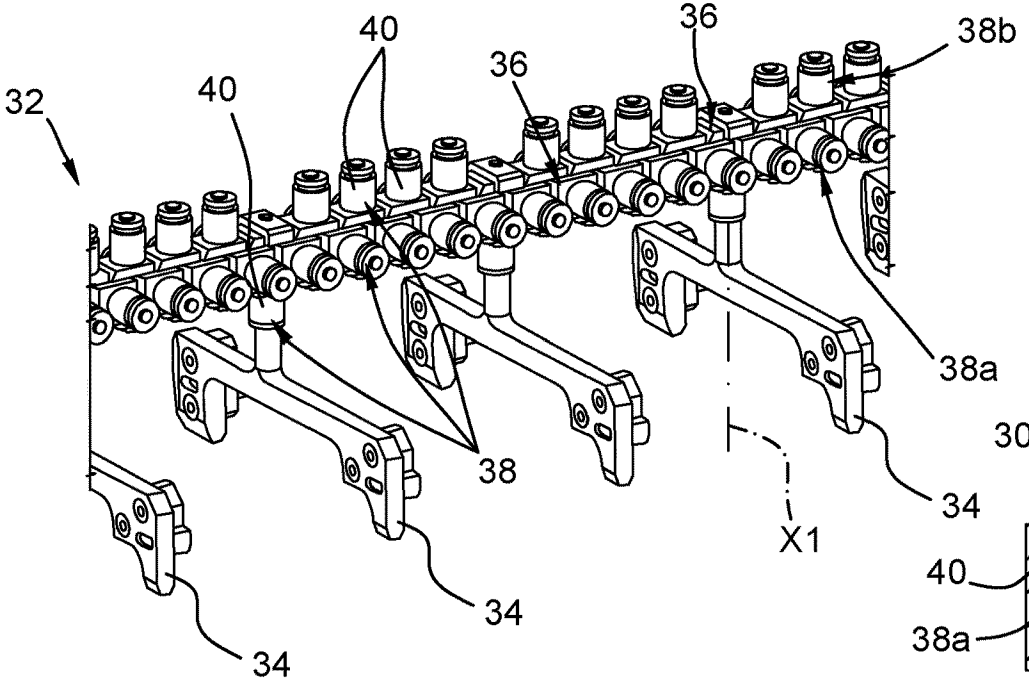

As shown in detail in FIGS. 7 and 8, each closed loop defined by each chain link 36 lies in a plane perpendicular to the plane in which the previous and/or next chain link 36 lies. In this regard, by way of example, in FIG. 7, reference number 36*a* and 36*b* designate two adjacent chain links. As it becomes particularly apparent when viewing FIG. 7, the link 36*a* is joined to link 36*b* by means of a connection that—as will be described in more detail below—provides such two components with three degrees of freedom, thus differing from a traditional chain (e.g. a bicycle chain).

In particular, pushing members 34 are arranged along conveying chain 32 spaced out by a predetermined distance, so that between two pushing members 34 a corresponding ammunition A can be housed, which must be guidedly transported along conveying guide 26. In particular, each one of pushing members 34 is mounted on a respective chain link 36 at predetermined intervals (e.g. at regular and periodic intervals) along conveying chain 32. More particularly, each one of pushing members 34 is mounted after a predefined number of successive chain links 36, depending on the diameter or calibre of the ammunition A to be conveyed.

Furthermore, each pushing member 34 is fixedly mounted to the respective chain link 36 along a mounting axis x1 substantially perpendicular to conveying chain 32.

As it will be further described below, chain links 36 carry respective sliding pins 38 on their sides.

In particular, sliding pins 38 rotatably support rollers 40 around themselves. Sliding pins 38 slide, preferably via rollers 40, within sliding structure 30, which, as aforementioned, substantially defines a rail along which conveying chain 32 is configured to slide and/or by which it is configured to be supported.

In particular, each roller 40 carried by the respective sliding pin 38 engages into a respective rail portion 30*a*, 30*b* that contributes to defining the sliding structure 30. In the embodiment illustrated herein, chain links 36 to which pushing members 34 are mounted have no associated sliding pin (and roller).

Figure 8A:
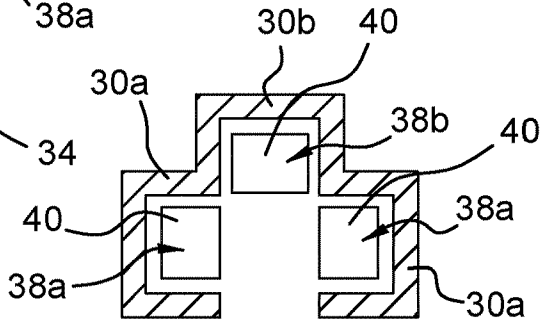
FIG. 8*a* is a schematic view that shows how the chain is guided along its path, in particular by rollers of the chain itself, shown in the preceding figures.

As illustrated in FIG. 8*a*, each one of rail portions 30*a*, 30*b* has a C-shape capable of receiving rollers 40 preferably carried by respective sliding pins 38 protruding from chain links 36, so as to guide and support conveying chain 32 as it moves in space.

More in detail, still with reference to the embodiment illustrated by way of example in FIGS. 7 and 8, each one of the horizontal chain links 36*a* has a lateral sliding pin 38*a* that protrudes from laterally opposite sides. The ends of lateral sliding pin 38*a* engage, under the sliding action of rollers 40, into corresponding lateral rail portions 30*a* of sliding structure 30.

Conversely, each vertical chain link 36*b* (e.g. when it lacks and does not support an associated pushing member 34) has respective central sliding pin 38*b* protruding from conveying chain 32 on the side axially opposite to the side from which pushing members 34 extend. The end of central sliding pin 38*b* slidably engages into a corresponding central rail portion 30*b* of sliding structure 30.

In the embodiment illustrated herein, each pushing member 34 is supported along its mounting axis x1 through the interposition of an additional roller 40 between it and chain link 36. In particular, at one end roller 40 is rotatably mounted to chain link 36, while at the other end it is rotatably integral with pushing member 34.

Figure 8B:
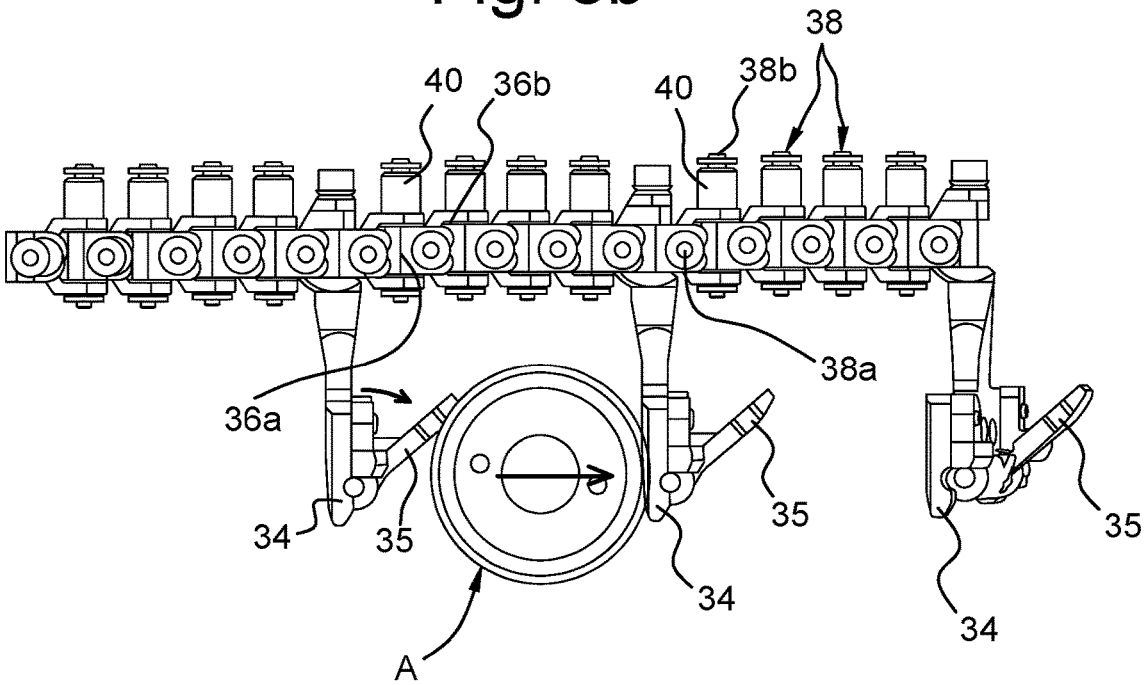
FIGS. 8*b* and 8*c* are views similar to those of FIGS. 7 and 8, which show an implementation variant of the previously shown chain.
Figure 8C:
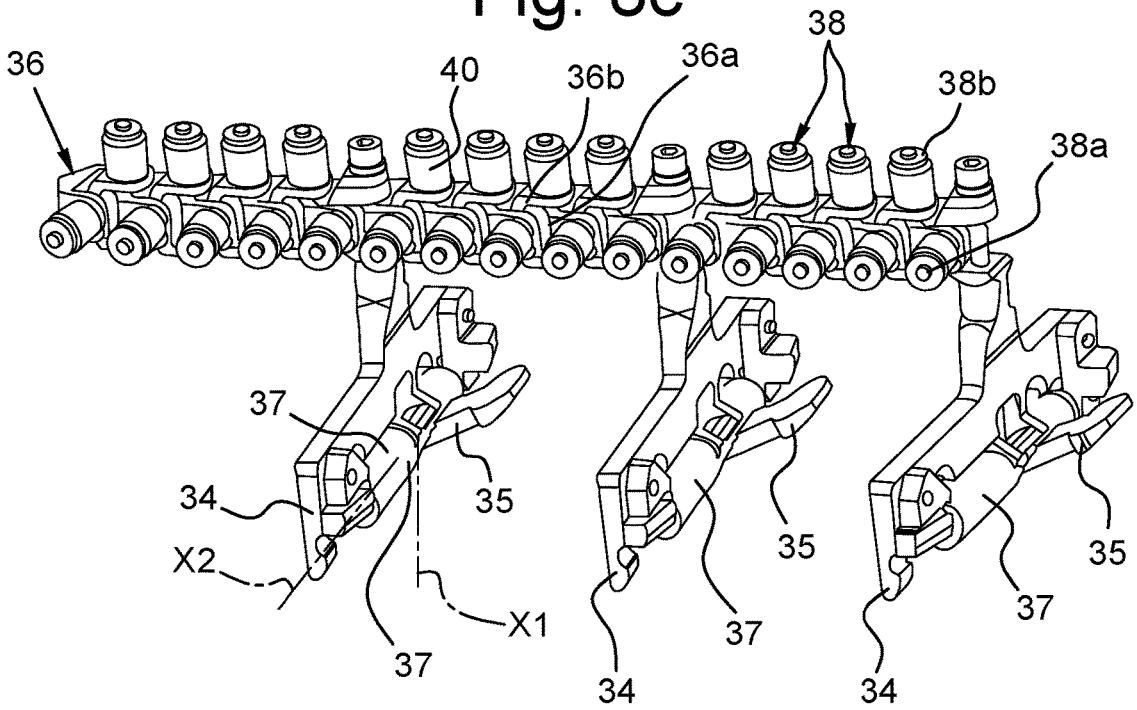

With reference to FIGS. 8*b* and 8*c*, there is shown a further implementation variant of conveying chain 32. Compared with the conveying chain illustrated in FIGS. 7, 8 and 8*a*, a lever 35 is associated with each pushing member 34. In particular, lever 35 is mounted to pushing member 34 and is elastically stressed so that it abuts against ammunition A. In this manner, considering that when viewing FIGS. 8*b* and 8*c* the ammunition feeding direction is from right to left, each ammunition A is pushed against the previous pushing member 34 by lever 35 mounted to the next pushing member 34.

Moreover, lever 35 is moved angularly away from pushing member 34 about a thrust axis x2, e.g. substantially perpendicular to mounting axis x1. In particular, a thrust spring 37 is provided, which is mounted between pushing member 34 and lever 35. Thrust spring 37 abuts on pushing member 34 at one end and on lever 35 at the other end. In the implementation variant illustrated herein, thrust spring 37 is, advantageously, a torsion spring.

Figure 8D:
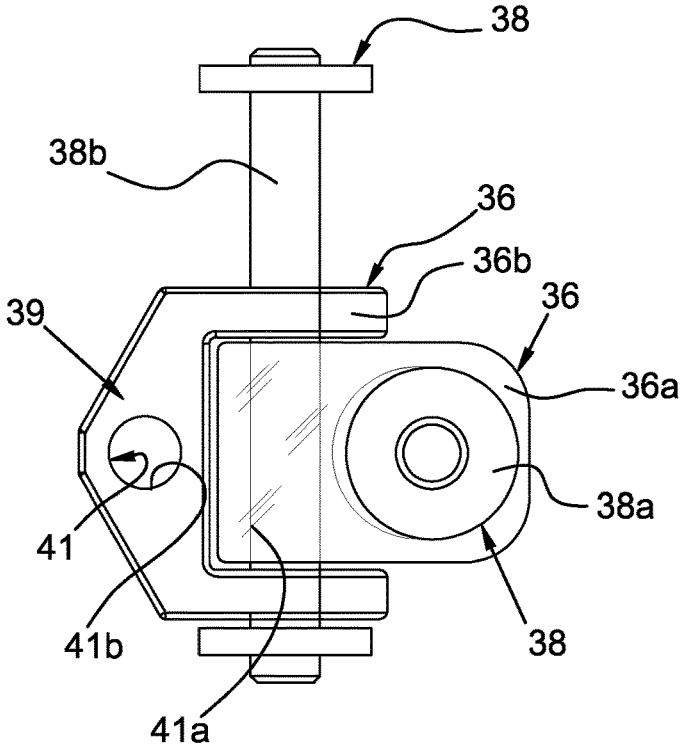
FIGS. 8*d* and 8*e* are views showing one possible and illustrative linking method that can be adopted for the links of the chain shown in FIGS. 7, 8 and 8*a* and respectively, of the one shown in FIGS. 8*b* and 8*c*.
Figure 8E:
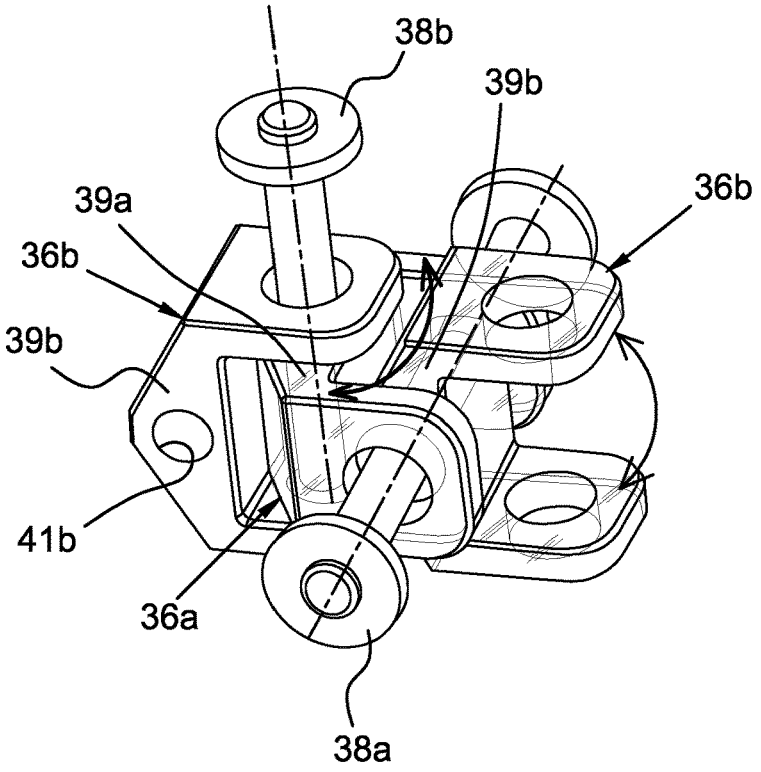

With reference to FIGS. 8*d* and 8*e*, there is shown an exemplary way of linking chain links 36. In the embodiment illustrated herein, chain links 36 consist of a C-shaped body 39 whose ends are crossed by a respective sliding pin 38; in other words, the closed-loop shape of each chain link 36 is defined by C-shaped body 39 and by a respective sliding pin 38.

In addition, still with reference to FIGS. 8*d* and 8*e*, each chain link 36 is connected to adjacent chain link 36 by means of respective sliding pin 38, which fits through a through bore 41 formed in the intermediate portion of C-shaped body 39 belonging to adjacent chain link 36, situated between the ends of chain link 36. For example, each vertical link 36*b* is connected to adjacent horizontal link 36*a* by means of central sliding pin 38*b* that fits through the (first) through bore 41*a* formed in the intermediate portion of horizontal C-shaped body 39*a*. Vice versa, each horizontal link 36*a* is connected to adjacent vertical link 36*b* by means of lateral sliding pin 38*a* that fits through the (second) through bore 41*b* formed in the intermediate portion of vertical C-shaped body 39*b*.

Figure 9:
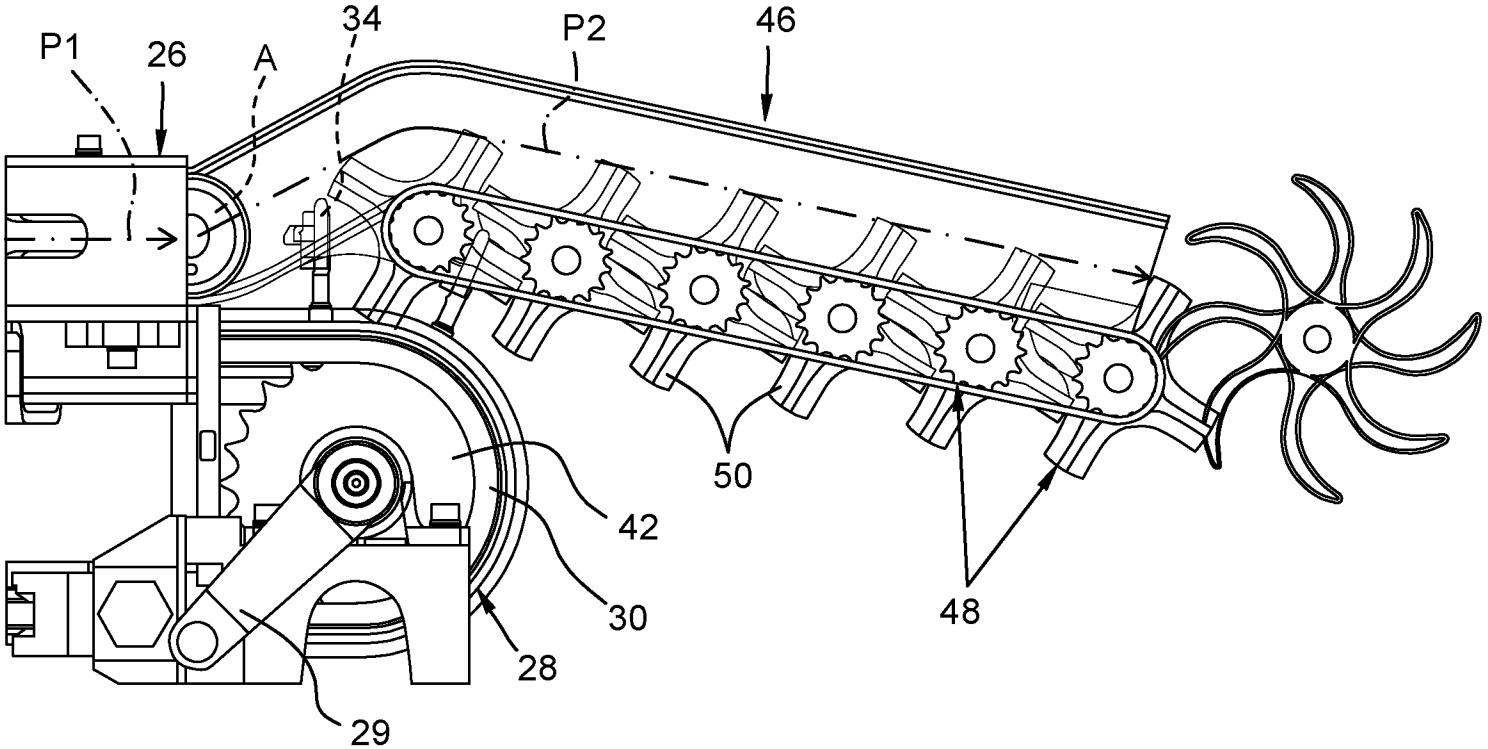
FIG. 9 is a side view of an ammunition loading guide of the feeding assembly, which allows the transfer of ammunitions from the last section of the chain to the firearm inlet.

With particular reference to FIGS. 6 and 9, conveying mechanism 28 further comprises a pair of gear wheels 42 co-operating with conveying chain 32 in order to move it along sliding structure 30. In particular, at gear wheels 42 sliding structure 30 is interrupted and allows sliding pins 38 of chain links 36 to engage with the crown formed by each one of gear wheels 42 in order to achieve the movement of conveying chain 32. More particularly, lateral sliding pins 38*a* are engaged between successive teeth of gear wheels 42. Even more particularly, central sliding pins 38*b* are engaged into an annular groove (not visible in the drawings) provided on each gear wheel 42; this limits the lateral displacement of chain links 36.

With particular reference to FIG. 9, feeding assembly 22 comprises also a loading guide 46 situated between conveying guide 26 and barrel 18. More in detail, loading guide 46 is adjacent to the outlet of conveying guide 26 at one end and adjacent to the inlet of barrel 18 at the other end.

In the embodiment illustrated herein, loading guide 46 defines a substantially straight and ascending loading path P2 for the ammunitions coming from conveying guide 26 and directed towards barrel 18.

Feeding assembly 22 further comprises a loading mechanism 48 configured to push the ammunitions A along loading guide 46 and towards the inlet of barrel 18. In particular, loading mechanism 48 comprises a plurality of loading star elements 50 arranged in series and mutually adjacent. Loading star elements 50 are configured to rotate and engage in succession ammunitions A which have come sideways from conveying guide 26 and which have arrived—still with a lateral orientation—at loading guide 46, so as to cause them to advance up to the inlet of barrel 18.

In particular, loading mechanism 48 is rigidly connected to firearm assembly 16, so that the actuation of the whole feeding assembly is regulated by firearm assembly 16 itself.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A linkless ammunition loading installation comprising:

a traversing portion configured to be rotatably mounted and supported on a stationary support structure, and to rotate about a traversing axis;

an elevating portion rotatably supported by said traversing portion about an elevating axis perpendicular to the traversing axis;

a firearm assembly supported by the elevating portion and comprising a barrel configured to fire ammunitions through the barrel;

a magazine carried by said traversing portion and configured to contain a plurality of linkless ammunitions to be fed to said barrel;

a feeding assembly configured to transfer the linkless ammunitions from said magazine to said barrel for firing said linkless ammunitions, said feeding assembly being carried by said elevating portion; and a transfer device configured to transfer said linkless ammunitions from said magazine to said feeding assembly;

wherein said magazine is separate and distinct from said elevating portion, and said feeding assembly is separate and distinct from said traversing portion;

wherein said transfer device is mounted on said traversing portion and comprises a star element rotatably supported about a rotation axis;

wherein said feeding assembly comprises a conveying guide mounted on said elevating portion and defining a path for transporting said linkless ammunitions from said transfer device towards said barrel;

wherein said rotation axis is parallel to said elevation axis;

wherein a center of ammunition to be picked up by said star element lies on said elevating axis during a part of a rotation path of said star element;

wherein said rotation axis is spaced apart from said elevating axis along a direction of said traversing axis;

wherein said conveying guide is provided as a rigid conduit;

wherein said conveying guide has an inlet located at said elevating axis; and wherein said inlet is crossed transversely by said elevating axis.

2. The installation according to claim 1, wherein said star element is aligned with the feeding assembly for rotating and picking up said linkless ammunitions exiting said magazine and supplying said linkless ammunitions to the inlet of said feeding assembly.

3. The installation according to claim 1, wherein said feeding assembly further comprises a conveying mechanism configured to push said linkless ammunitions along said conveying guide.

4. The installation according to claim 3, wherein said conveying mechanism comprises:

a hollow sliding structure, a conveying chain sliding in a cavity defined by said sliding structure, and a plurality of pushing members sliding in said conveying guide and carried by the conveying chain, each one of said pushing members being configured for pushing a respective linkless ammunition adjacent each one of said pushing members.

5. The installation according to claim 4, wherein said sliding structure comprises a guide in which said conveying chain slides and from/by which said pushing members are suspended and/or supported.

6. The installation according to claim 1, wherein said feeding assembly further comprises a loading guide positioned between said conveying guide and said barrel.

7. The installation according to claim 6, wherein said feeding assembly further comprises a loading mechanism configured to push said linkless ammunitions along said loading guide towards an inlet of said barrel.

* * * * *